United States Patent [19]

Chavoor

[11] 4,306,424

[45] Dec. 22, 1981

[54] COLD PLATE

[76] Inventor: Winston Chavoor, 4022 Rusting Ave., Oakland, Calif. 94605

[21] Appl. No.: 115,357

[22] Filed: Jan. 25, 1980

[51] Int. Cl.[3] ..... F25D 3/08

[52] U.S. Cl. ..... 62/457; 62/371; 62/529

[58] Field of Search ..... 62/370, 371, 430, 457, 62/529, 530

[56] References Cited

U.S. PATENT DOCUMENTS

| | | | |
|---|---|---|---|
| 2,767,563 | 10/1956 | Picascia | 62/457 X |
| 3,678,703 | 7/1972 | Cornish et al. | 62/371 |
| 3,757,852 | 9/1973 | Allinger | 62/457 X |
| 3,858,410 | 1/1975 | Drake | 62/457 X |
| 3,922,879 | 12/1975 | Arnold | 62/529 X |
| 4,019,340 | 4/1977 | Conklin | 62/371 |

*Primary Examiner*—Lloyd L. King

*Attorney, Agent, or Firm*—Bielen and Peterson

[57] ABSTRACT

A cold plate comprising a container having an opening and being capable of holding a refrigerating medium. A heat conducting element positions over the opening in the container and is positioned to be in a heat conductive relationship with the refrigerating medium. A moisture seal prevents condensate from the object being cooled from reaching insulation within the container.

5 Claims, 3 Drawing Figures

10
16
26
24
48
46
36
42
40
38
50
32
30
22
20
14
18

FIG-2
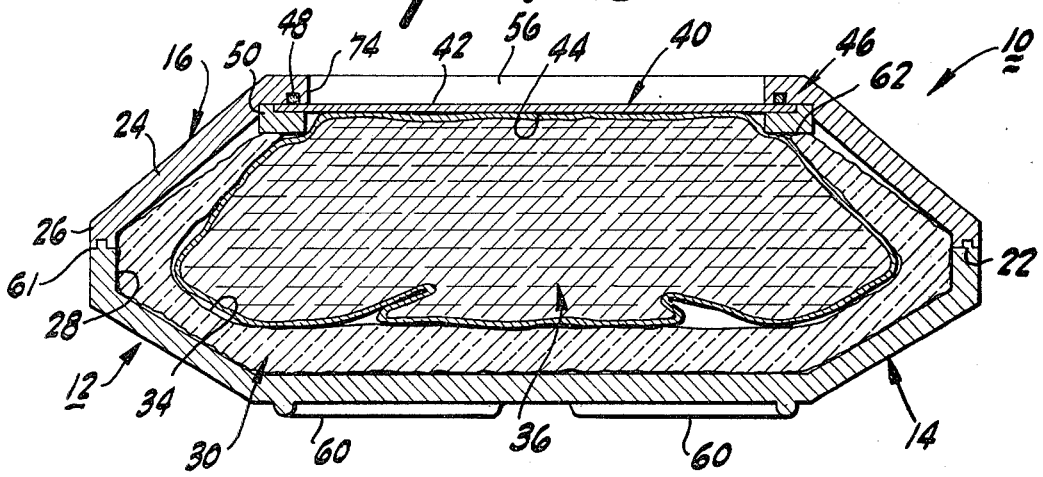
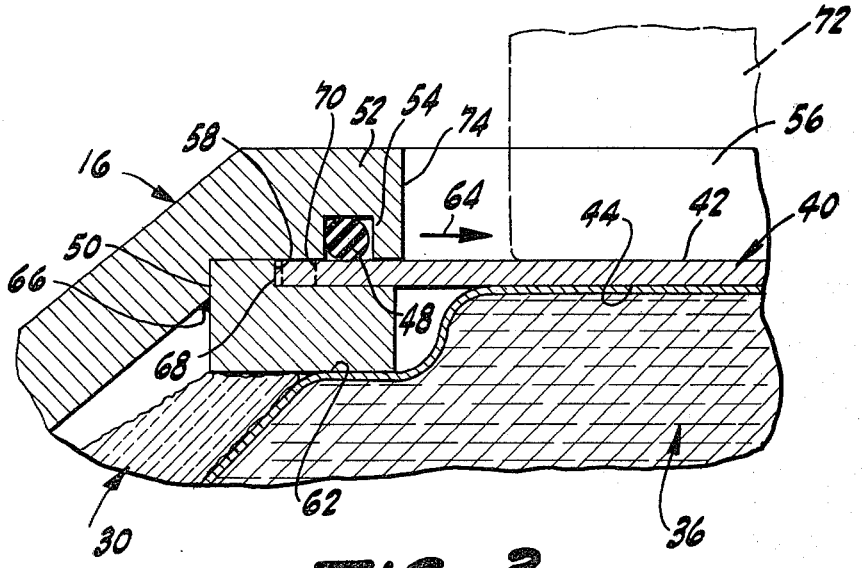
FIG-3

COLD PLATE

BACKGROUND OF THE INVENTION

The present invention relates to a novel cold plate particularly useful in refrigerating food articles.

Many comestible items require refrigeration to prevent or retard bacterial growth. This is especially pertinent in the handling of dairy products such as milk, cream, butter, and the like, although not limited to this class of goods. It has been found that bacterial growth is severely restricted if many food products are kept below 55°, eg: refrigerated. Where food products are served, such as the restaurant setting, many items are placed on the table for hours at a time without refrigeration. This practice has led to the spoiling of dairy products as well as to the possibility of exposing humans to bacterial infection.

Prior devices have been proposed which have attempted to solve this problem by proposing various portable refrigeration units. For example, U.S. Pat. No. 2,039,736 to Munters discloses a refrigeration thermos which employs eutectic solutions in a sleeve. U.S. Pat. No. 3,089,317 to Bufalini shows a heat exchanging attachment for receptacles which uses a container which sits above a pot holding eutectic material. An air gap separates the eutectic material from the bottom of the container. The Burg U.S. Pat. No. 3,286,483 and Peters U.S. Pat. No. 3,383,880 describe various serving dishes using eutectic materials in direct contact with supporting plates thereabove. The Drake U.S. Pat. No. 3,858,410 describes a slab for mixing dental materials which includes a coolant enclosed in a plastic container. The slab and coolant are supported on a plastic base.

None of the prior devices provides for adequate insulation of the coolant. In this regard, reference is made to U.S. Pat. No. 2,779,495 to Davis which describes an insulated coaster for drinking glasses. Also, cold plates or heat sinks must be resistant to extreme temperature conditions ranging from −10° F. in a freezer to approximately 180° F. in a dishwasher. In this regard, any insulation must be protected adequately against moisture intrusion from the condensate and washing liquids such as soap and water. No prior devices are known which solve the heretofore delineated problems.

SUMMARY OF THE INVENTION

In accordance with the present invention a novel and useful cold plate is provided.

The cold plate of the present invention includes a container having an opening and being capable of holding a refrigerating medium such as a eutectic mixture of salt and water or any other known composition. The container may be constructed of a dishwasher, resistant plastic, and the like.

A heat conducting element which may be in the form of a plate having a top portion and a bottom portion is positioned over the opening of the container and is conductively cooled by the refrigerating medium.

The device also includes insulating means for the refrigerating medium within the container. The cold plate also has means for moisture sealing the insulating means from condensate in the vicinity of the heat conducting element and moisture inherent in the washing and cleaning process. Such moisture sealing means may include a retainer supporting the bottom of the heat conducting element and guiding the same during thermo contraction and expansion. A gasket may also be employed to substantially surround the top of the heat conducting element. Finally, the gasket retainer is provided to restrict movement of the gasket in relation to the heat conducting element. Such gasket retainer may be provided by a portion of the container.

To add to the structural strength of the device, the retainer may be connected to the container by the use of fastening means such as sonic welding. The insulation means may be formed to partially support the retainer in position.

It may be apparent that a novel and useful cold plate has been described.

It is therefore an object of the present invention to provide a cold plate useable with food products which will maintain food products at a temperature which will prevent or retard bacterial growth therewithin.

It is another object of the present invention to provide a cold plate which includes adequate insulation for the refrigerating medium used therein.

It is still another object of the present invention to provide a cold plate which seals the insulation against moisture penetration and which adequately maintains a moisture seal in extreme temperature conditions caused by a freezer and a dishwasher.

It is another object of the present invention to provide a cold plate which may be activated by a home freezer.

It is another object of the present invention to provide a cold plate which is compact, aesthetic, and easily sanitized.

The invention possesses other objects and advantages especially as concerns particular characteristics and features thereof, which will become apparent as the specification continues.

BRIEF DESCRIPTION OF THE DRAWINGS

FIG. 2 is a sectional view of the device of the present invention.

FIG. 3 is an enlarged sectional view broken away from FIG. 2 showing the moisture sealing mechanism in relation to thermal effects.

Figure 1:
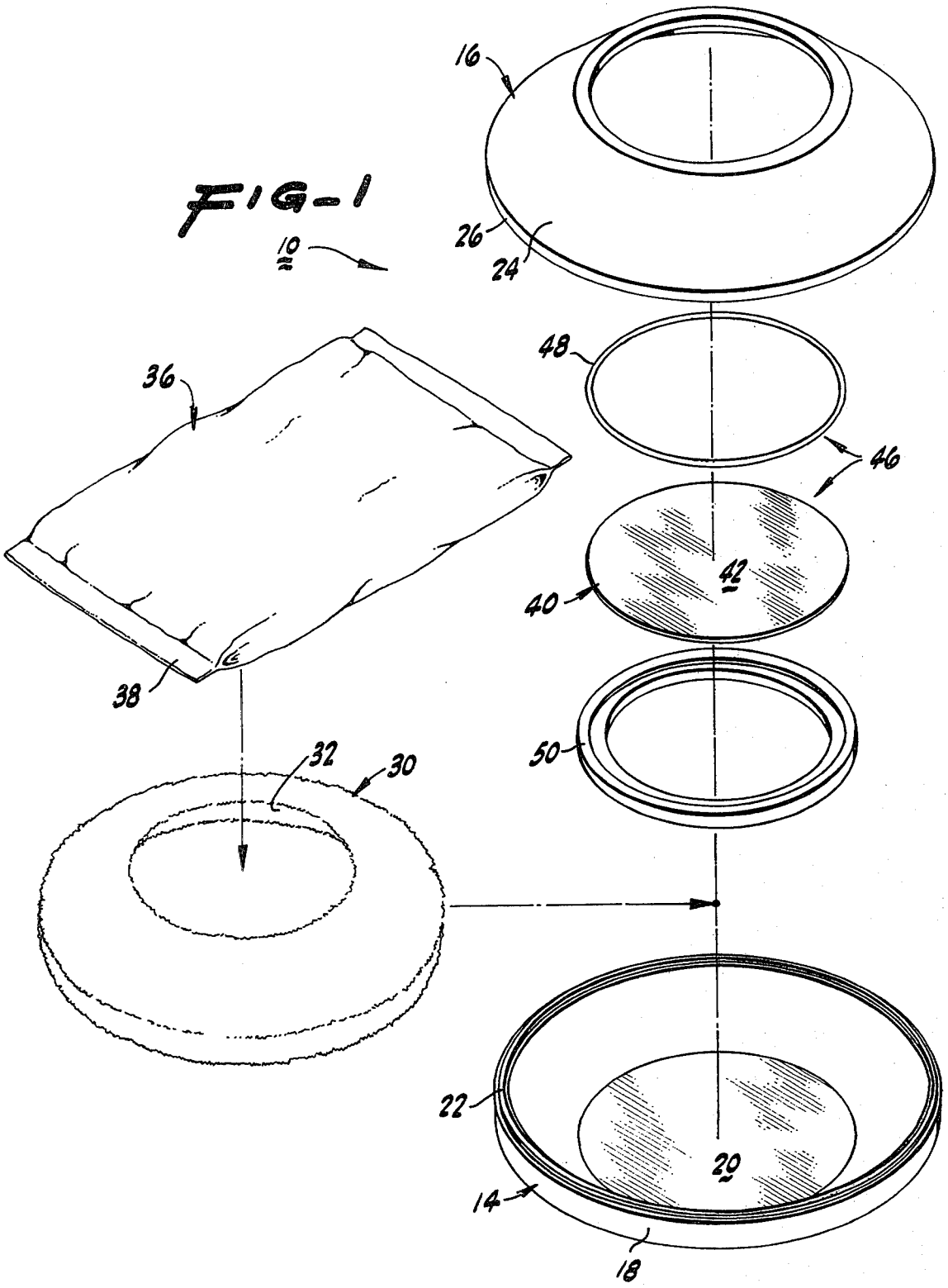
FIG. 1 is an exploded view of the device of the present invention.

For a better understanding of the invention reference is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

With reference to FIG. 1, the cold plate of the present application is described by reference character 10 in its entirety, and includes as one of its elements a container 12 having a lower portion 14 and an upper portion 16. Lower portion 14 includes side 18 and bottom 20. Lip 22 surrounds the top portion of side 18. Upper portion 16 of container 12 includes side 24 which terminates in edge 26. Lip 22 and edge 26 are intended for mating and permanent sealing. Container 12 may be constructed of hard ABS Plastic which is capable of resisting temperatures ranging from −140° F. to 250° F. Non-conductive materials such as plastic would aid in the insulation properties of cold plate 10 and be warmer to the touch when handling, although container 12 is not deemed to be limited to this type of material.

The cavity 28, FIG. 2, formed by the mating of lower portion 14 and upper portion 16, holds insulation means 30. Insulation means 30 may be plastic, foam, and like materials. Insulation means 30 may be formed into a double-conical shape to generally conform to the cavity 28 and possess an opening 32 into cavity 34. A refrigerating medium 36 contained in a water impervious bag 38 fits within cavity 34. Refrigerating medium 36 may be a eutectic mixture of water and salt, water and ethanol, and the like, well known in the art.

The cold plate also includes a heat conducting element 40. Element 40 has a top surface 42 and a bottom surface 44 defining a disc shaped element 40. Heat conducting element 40 may be constructed of metal or other material having relatively good thermo-conductivity .

The cold plate 10 also includes means 46 for moisture sealing insulating means 30. The preferred embodiment includes gasket or O-ring 48 which substantially surrounds the top surface 42 of heat conducting element 40. Retainer 50 supports the bottom 44 of heat conducting element 40. Turning to FIG. 2, it may be seen that gasket 48 fits within gasket retainer 52. Container 12 provides gasket retainer 52 in the form of a recess 54 on the upper portion thereof.

Heat conducting element 40 is positioned over opening 56 below gasket retainer 52. A ridge 60 on the bottom surface of bottom 20 aids in the retention of the refrigerating properties of refrigerating medium 36. Upper portion 16 and the lower portion 14 of container 12 are glued, welded, or otherwise fastened at joint 61. Insulating means 30 may be structured to offer some support to retainer 50 at surface 62 thereof.

With reference to FIG. 3, notch 58 of retainer 50 forms a platform or guide for heat conducting element 40 during thermal expansions and contractions. Retainer 50 is preferably constructed of plastic material and therefore would possess a lower coefficient of thermal expansion than heat conducting element 40. As shown in FIG. 3, heat conducting element 40 has been expanded to its approximate maximum position. Phantom edge 67 shows the approximate position of element 40 at room temperature, i.e. 0.0025 mm from retainer 50. Arrow 64 indicates the direction of shrinkage of heat conducting element 40 when frozen. Retainer 50 is sonic welded at seam 66 or otherwise connected to container 12. During extreme heating of cold plate 10, gasket 48 will maintain the moisture seal between the external area, including top portion 42 of heat conducting element 40, and insulation 30. Insulation 30 loses its insulating qualities when wetted. Also, ice within container 12 would damage the integrity of the same. In the extreme, means 46 will perform its function although cracks may appear along weld seam 66. Likewise, movement of heat conducting element 40 in a direction of arrow 64, would be greater than the shrinking of retainer 50. Any gap appearing between the periphery of heat conducting element 40 and retainer 50 in notch 58 would not disturb the integrity of means 46. In other words, the edge 68 of heat conducting element 40 would not extend inwardly beyond phantom edge 70. Moisture may originate from condensation forming on body 72 as well as moisture originating from any washing activities. It should be noted that heat conducting element 40 is recessed or lowered from the top of container 12. Wall 74 would offer support to body 72 and prevent tipping or turning of the same. This, of course, is especially useful when body 72 contains liquids to be cooled such as milk, cream, and the like.

In operation, cold plate 10 is assembled as shown in FIGS. 1-4 and heretofore described. Device 10 is then placed in a freezer until the temperature of the same is approximately −10° F. Device 10 is then placed on a table or any other area for use at ambient air temperature. Body 72 is placed on top surface 42 of heat conducting element 40 and cooled by the action of refrigerating medium 36. This cooling process is primarily accomplished by a conduction although heat may be transferred from body 72 to refrigerating medium 36 by convection or radiation. It has been found that a container having a diameter of approximately 15 centimeters and a height of approximately 6 centimeters will maintain a temperature below 55° F. for about eight hours. After the predetermined period of time determined to be the useful refrigerating capacity of cold plate 10, it may be washed in a dishwasher, rechilled, and reused.

It has been found that proper choice of materials will permit cold plate 10 to serve as a warming dish since the eutectic mixture 36 may be boiled as well as frozen and retain heat thereafter.

While the foregoing specification embodiments of the invention have been set forth in considerale detail for the purposes of making a complete disclosure of the invention, it will be apparent to those of ordinary skill in the art that numerous changes may be made in such details without departing from the spirit and principles of the invention.

What is claimed is:

1. A cold plate comprising:

a. a container having an opening, said container being capable of holding a refrigerating medium;

b. a heat conducting element having a top and a bottom, said heat conducting element being positioned over said opening of said container and intended for being in a heat transfer relationship with the refrigerating medium;

c. means for insulating said refrigerating medium, said insulating means being within said container;

d. means for moisture sealing said insulating means from said heat conducting element during thermal contraction and expansion of said heat conducting element, said moisture sealing means comprising:

a retainer supporting the bottom of said heat conducting element;

a gasket substantially surrounding the top of said heat conducting element; and a gasket retainer restricting movement of said gasket in relation to said heat conducting element.

2. The cold plate of claim 1 in which said retainer is connected to said container.

3. The cold plate of claim 2 in which said insulation means at least partially supports said retainer.

4. The cold plate of claim 3 in which said gasket retainer comprises a recess formed by a portion of said container.

5. The cold plate of claim 1 in which said retainer provides means for guiding said heat conducting element during thermal contraction and expansion.

* * * * *